US007384041B2

(12) United States Patent
Flickner et al.

(10) Patent No.: US 7,384,041 B2
(45) Date of Patent: Jun. 10, 2008

(54) MAILING PIECE BUFFER SYSTEM

(75) Inventors: Brett Flickner, Folsom, CA (US); Jack Cai, Davis, CA (US); Remesh Kuruppath, Folsom, CA (US)

(73) Assignee: DST Output, El Dorado Hills, CA (US)

( * ) Notice: Subject to any disclaimer, the term of this patent is extended or adjusted under 35 U.S.C. 154(b) by 289 days.

(21) Appl. No.: 10/932,698

(22) Filed: Sep. 2, 2004

(65) Prior Publication Data

US 2006/0055104 A1 Mar. 16, 2006

(51) Int. Cl.
*B65H 5/34* (2006.01)

(52) U.S. Cl. ..... 271/266; 271/270; 271/2; 271/265.02

(58) Field of Classification Search ..... 271/266, 271/270, 256, 2, 258.01, 259, 265.01, 265.02; 270/58.06

See application file for complete search history.

(56) References Cited

U.S. PATENT DOCUMENTS 3,948,564 A 4/1976 Flint
4,544,146 A 10/1985 Zemke et al.
4,707,790 A 11/1987 Gomes et al.
5,003,538 A 3/1991 Lee et al.
5,029,832 A 7/1991 Orsinger et al.
5,058,873 A 10/1991 Hewitt et al.
5,179,522 A 1/1993 Scribe
5,503,388 A 4/1996 Guenther et al.
5,538,140 A 7/1996 Guenther et al.
5,613,669 A 3/1997 Grueninger
5,724,791 A * 3/1998 Pishny et al. ..... 53/501
5,761,535 A * 6/1998 Neifert et al. ..... 710/62
5,816,715 A 10/1998 Harman et al.
5,826,869 A 10/1998 Nyffenegger et al.
5,860,504 A 1/1999 Lazzarotti
6,131,053 A 10/2000 Nyffenegger et al.

* cited by examiner

*Primary Examiner*—Kaitlin Joerger
(74) *Attorney, Agent, or Firm*—James M. Ritchey

(57) ABSTRACT

A document transfer buffer device for holding temporarily a document between an upstream document feeding device and a downstream envelope inserter has a transporting device for moving the document from the upstream document feeding device to the envelope inserter and an envelope holding device for temporarily holding the document in a holding location between the upstream document feeding device and the envelope inserter and a controlling program that selectively activates the transporting device and the temporary holding device and is responsive to the upstream feeding device and the envelope inserter possible error conditions that initiate document holding and releasing situations.

15 Claims, 5 Drawing Sheets

MAILING PIECE BUFFER SYSTEM

BACKGROUND OF THE INVENTION

1. Field of the Invention

This invention pertains generally to a system for temporarily halting the flow of one or more incoming mail pieces into an envelope inserter apparatus. More particularly, the subject invention relates to a document buffer system having a controlling program that is utilized in connection with a document interface feeding device, an envelope inserter, and documents being transferred through the interface feeding device into the inserter, wherein one or more of the incoming documents may be temporarily halted, within the interface feeding device, before entry into the envelope inserter and buffered or cued in known order until the controlling program directs any cued documents to once again enter the envelope inserter.

2. Description of Related Art

Traditionally, when a series of document packets (often one or more pages in a billing statement for goods and/or services provided) are delivered by a transport device to an envelope inserter and an error is detected in the process there were three solutions: 1) the transporter is stopped, with the accompanied stoppage in production until the problem is resolved; 2) the transporter continues running, the envelopes filled, and the error is resolved later; and 3) the transporter continues to run with the problem document packets diverted out of the production process. However, there are two significant problems with the traditional solutions: 1) reduced productivity and 2) reduced quality. For whatever reason the inserter stops (there are many and they often occur about every minute, during the average process), the negative results are the same. All document packets that are in transition (frequently, from one to four) stack up either in the inserter track of in a diverter tray. After an operator rectifies the inserter error, the operator must remove the document packet(s), manually separate then from each other, insure that each document packet is complete and correct, and hand place them back into the track one at a time while cycling the inserter between them. Clearly, this corrective action is time consuming and can significantly increase the time to complete a job (often as much as a 30% increase). Also, human intervention of document packet production always increases the chance of making significant quality errors. The operator can inadvertently make several different errors; not separating two document packets that may have nested when stacked will result in two document packets mailed in the same envelope, mixing sheets from one document packet with another when separating them will result in incomplete or incorrect mailed document packets placing document packets in the track in the wrong sequential order will result in improper insert matching, or placing document packets in the track in the wrong orientation will result in undeliverable mail. Plainly, many difficulties existed in the prior error-resolution processes.

Several mechanisms already exist to divert of buffer the flow of documents during document transfers in numerous specific settings, but these mechanisms do not make obvious, teach, suggest, or imply in any manner the subject invention.

U.S. Pat. No. 3,948,564 discloses a fluid bearing apparatus and method that utilizes a selective turntable diverter structure to temporarily store identical items in a buffer station. The buffer station merely maintains a ready pool of identical items to supply the needs of an associated apparatus. No item sequence information is recorded or needed with this device.

Described in U.S. Pat. No. 4,544,146 is an insertion machine with control signals stored on searchable medium. Envelopes are printed with desired information and utilized (buffered and flipped) with an inserter and associated inserter stations.

A control signal buffer for use in an inserter system is related in U.S. Pat. No. 4,707,790. An information control buffer, no physical item is buffered, is provided in which control information from the supervisory controller to the sheet inserter system is buffered so that synchronicity is achieved between the transfer of batches of documents from a web of incoming documents and what is actually inserted into designated envelopes.

A communication network and protocol for real-time control of mailing machine operations is disclosed in U.S. Pat. No. 5,003,538. Information buffers within microprocessors are utilized to facilitate the transfer of controlling information to operate a traditional mailing machine.

U.S. Pat. No. 5,029,832 presents an in-line rotary inserter for use with an envelope inserting machine. A number of diverter stations are disposed ahead of the envelope inserting station for diversion of envelopes and inserts and ahead of the inserted envelope stacking assembly to divert inserted envelopes during normal operation and detected error situations. Upon detection of an error situation, the subject invention halts incoming statements before any envelopes are encountered.

U.S. Pat. Nos. 5,503,388 and 5,538,140 disclose a buffered stacker that selectively diverts horizontally disposed documents from a main conveying path, then stacks and transports the documents to replaceable receiving containers. This system directly diverts the selected documents away from the conveying path and does not allow any selected documents to reenter the main conveying path.

Described in U.S. Pat. No. 5,613,669 relates a control process for use in the production of printed products and means for performing the process. In the sequential assembly of multi-page document sets a controller, using a camera/detector, is utilized to scan and analyze each incoming page to determine if the correct page has been delivered and, if not, to direct corrective actions.

U.S. Pat. No. 5,816,715 outlines an interfacing mechanical buffer that allows two streams of materials to be united, even if the rates of flow of the materials from each of the two streams differ. To merge two streams of documents, each traveling at different speeds, one stream is slowed by having a mechanical buffer receive the documents and then release them in a first-in-first-out order. The mechanical buffer comprises a matched set of four helical-shaped screws that receive a incoming document, rotate to receive additional documents, and permit discharge of the received documents in order of their entrance to the buffer.

U.S. Pat. Nos. 5,826,869 and 6,131,053 present a high throughput document-processing machine having a dynamic speed control. The device merely directs the flow accumulated sets of documents from a first transport pathway to a second transport pathway if a jam is detected in the first pathway.

A transporter buffer and inserter method are disclosed in U.S. Pat. No. 5,860,504. A plurality of sensors detect positions of items in a transfer system and stop the items at predetermined locations based upon when the items should enter a receiving area.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teaches or renders obvious, singly or when considered in combination, applicant's claimed invention.

BRIEF SUMMARY OF THE INVENTION

An aspect of the invention is to provide an information and physical mailing piece buffer to temporarily store at least one mailing piece or document packet and associated information in the event that an error is detected in relation to an inserter that is to receive the mailing piece or document packet for insertion into a mailing envelope.

Another aspect of the invention is to disclose a buffer system, utilized prior to an envelope inserter apparatus, for temporarily halting and holding, upon detection of a processing error, one or more incoming mailing pieces or document pieces and then releasing the held incoming mailing pieces or document packages upon resolving the difficulty that generated the halting error.

A still further aspect of the invention is to relate a computer program controlled document interface feeding device, utilized immediately prior to an envelope inserter, and with documents being transferred through the interface feeding device into the inserter, wherein if an error is detected in the processing of the incoming documents, one or more of the incoming documents may be temporarily halted and held within the interface feeding device, before entry into the envelope inserter and buffered or cued in known order until the controlling program processes the detected error and the error situation is remedied and then directs any cued documents to once again enter the envelope inserter.

The computer controlled subject transporter comprises a supporting frame having a plurality of lower and upper pulleys and belts along the general configuration of a conveyor. Document packets (often mailing pieces) enter the subject transporter either directly or indirectly from the output of a folder, or the like, and are contained between the upper and lower pulleys and belts and passively gripped. The belts are driven by an encoder controlled motor actively linked to the inserter. Along the document packet travel path, under the belts, are computer controlled gates for stopping individual document packets that can each be activated independently. Activation is often by associated pneumatic cylinders of electric solenoids. When activated, each gate moves into the document packet pathway and blocks the movement of the document packet. Since the belts only grip the document packet passively, the belts slip on the document packet for a short duration until the belts cease movement, as directed by the controlling computer. When the error is corrected each gate may be disengaged to permit normal transport.

The general software logic utilized by the controlling computer system detects that the downstream equipment (usually the inserter) is not able to receive a document packet it will determine to "buffer" or halt and hold delivery of the document packet, then it will determine to buffer additional document packets until the upstream equipment can be stopped. As the incoming document packets enter the subject transporter buffer, the first document packet proceeds to the last buffer gate (the furthest downstream) and is held. The following document packet proceeds to the second to last buffer gate and is held, continuing until all of the buffer gates are filled. Once the last statement is buffered, the subject transport belts stop. After the errors are remedied and the inserter is "armed" to begin processing, the system controller is directed to resume production, the inserter cycles to the ready position. The transport belts start movement and the buffer releases the first document packet which is delivered into the insert track. The inserter cycles once more and the buffer releases the second document packet. This continues for all subsequent document packets. Once the subject buffer is empty of held document packets the system begins normal operation automatically. Document packet detection sensors are located in the document packet travel path to indicate the presence or absence of a statement at each subject gate. Each sensor insures that a document packet has arrived at the appropriate gate, as expected, that document packets have not slipped past a gate while buffered, that document packets have not been removed while buffered, and that document packets have departed, as expected. If any of these difficulties occur, the system controller notifies the operator of the condition.

Advantages of the subject invention include, but are not limited to, increased productivity and enhanced quality. If the downstream equipment (the inserter) is not ready to receive document packets (such as the inserter has stopped for a jam), the document packets that have been sent to the inserter (perhaps from a collator and/or folder) continue to be transported toward the inserter. The subject buffer fills up with the incoming document packets and the system stops. After the operator rectifies the inserter stop reason, the operator can begin document packet production without regard to those document packets in the subject buffer. The system automatically delivers the document packets cued in the buffer one at a time into the inserter track with the assurance that no two document packets are nested together, no sheets are mixed up with another document packet, document packets maintain their original sequence order, and document packets are in the proper orientation (i.e. face down, top way, or whatever proper orientation is required). With the assurance of these actions, there is a guarantee that the quality issues have been eliminated (two document packets mailed in the same envelope, incomplete document packets mailed, improper insert matching, or undeliverable mail). Also, the entire time that this process is taking place automatically, the operator is available to attend to other system needs, such as restocking inserter hoppers and unloading completed mail pieces into the mailing trays. By doing so, the operator will be more efficient and can complete the job assignment is a shorter time.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 1:
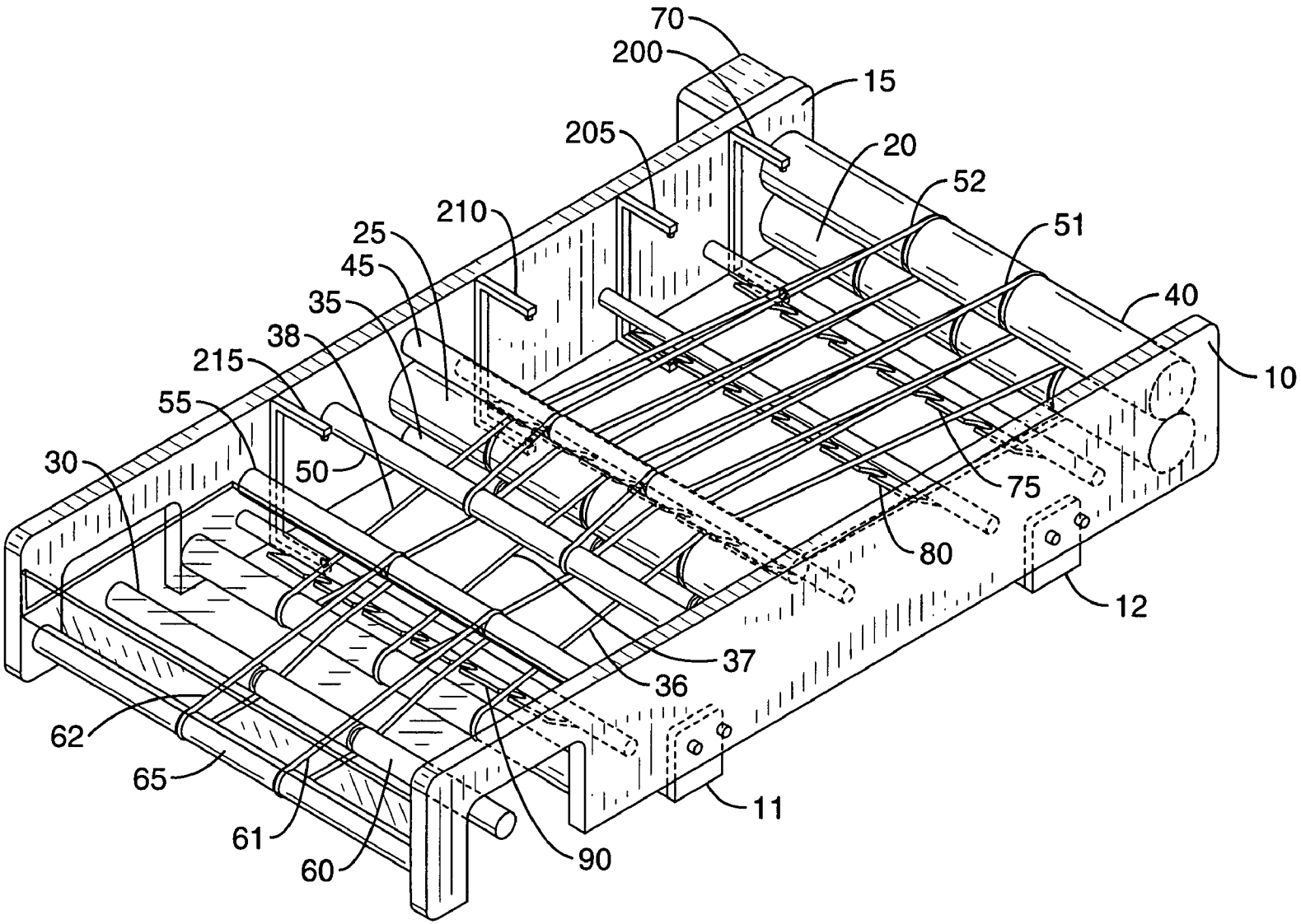
FIG. 1 is a perspective view of the subject device.

Referring more specifically to the drawings, for illustrative purposes the present invention is embodied in the apparatus and software diagram generally shown in FIG. 1 through FIG. 5. It will be appreciated that the apparatus may vary as to configuration and as to details of the parts, and that the method may vary as to the specific steps and sequence, without departing from the basic concepts as disclosed herein.

It should be appreciated that a conventional envelope inserter apparatus is utilized in conjunction with the subject buffer invention. The envelope insertion operation is generally carried out by conventional inserter apparatus which provides for the collecting or assembling of several sheets of mail materials together into packets, and the insertion of the assembled packets into envelopes to produce a mailing piece. In standard inserter devices, a stream of opened envelopes is generally conveyed past an inserter arm by a conveyor system. Individual inserts are obtained from insert hoppers and added to billing statements (comprised of one or more pages of listed charges for a service rendered and other relevant information) or other items to form the packets, and the assembled packets are sequentially directed by conveyor means to the inserter arm. The inserter arm then inserts or stuffs each packet of mail materials into an opened envelope by pushing the packet with pusher members or pusher fingers. The filled or stuffed envelopes are then generally directed to an envelope sealing operation. The inserter and pre- and post-processing equipment are controlled by a system computer programmed to coordinate mailing piece assembly and to monitor the entire system for errors in assemble and processing.

The controlling computer programming halts the envelope insertion process when an unsuitable occurrence or error is detected at some specific point in the overall process of the document packet or mailing piece assembly. Usually, a document interface feeding device delivers a document packet of mailing items, like billing statements, from a printer, folder, collator, or other device or combination of devices to the envelope inserter. Document packets are transferred through the interface feeding device into the inserter, if the process is interrupted or if an error is detected in the processing of the incoming documents, one or more of the incoming document packets may be temporarily halted, within the subject buffer, before entry into the envelope inserter and buffered or cued in known order until the controlling program processes the detected error and the error situation is remedied (usually by diverting the incoming document packet(s) to a separate hand-processing area) and then directs any cued document packets to once again enter the envelope inserter.

Specifically, as seen in FIG. 1-4, the subject buffer device 5 comprises a supporting frame generally having two opposing side walls 10 and 15. The side walls 10 and 15 are secured to one another by any suitable standard means such as the illustrated cross-support members 11 and 12.

Extending between and secured to the side walls 10 and 15 are a plurality of rotating cylinders or pulleys that support and drive a series of transport belts. Pulleys 20, 25, 30, and 35 generate a lower transport belt path to support and drive the lower transport belts 36, 37, and 38. Pulleys 40, 45, 50, and 25 generate a first upper transport belt path to support and drive first upper transport belts 51 and 52. Pulleys 55, 60, 65, and 30 generate a second upper transport belt path to support and drive second upper transport belts 61 and 62. In combination, these pulleys and belts configure a conveyor system to move documents packets into the inserter. In FIGS. 1-4 each document packet enters the subject device from the right and is moved to the left as the pulleys and belts rotate to transport the document packets. Document packets (often mailing pieces) enter the subject transporter (from the right in the illustrations) either directly or indirectly from the output of a folder, or the like, and are contained between the upper and lower pulleys and belts and passively gripped (gripped with enough force for movement, but not enough force to damage the document packets as the belts slide over them should the packets be temporarily halted upon detection of an error). The pulleys/belts are driven by an encoder controlled motor 70 or motors actively linked to operational timing of the inserter.

Along and below the document packet travel path are computer controlled gates 75, 80, 85, and 90 for stopping, when stop-errors are detected, individual document packets at separate specific locations in the travel path. Although other equivalent methods may be utilized to move a gate into and out of the document packet travel path, preferably each gate 75, 80, 85, and 90 pivots about a rotational axis 76, 81, 86, and 91 into the document packet path to block transfer of a document packet and pivots out of the path to release a document packet. Each gate 75, 80, 85, and 90 comprises an elongated plate with suitably positioned notches to accommodate passage of the belts when the gate is pivoted into the document packet path to block a desired document packet.

Figure 2:
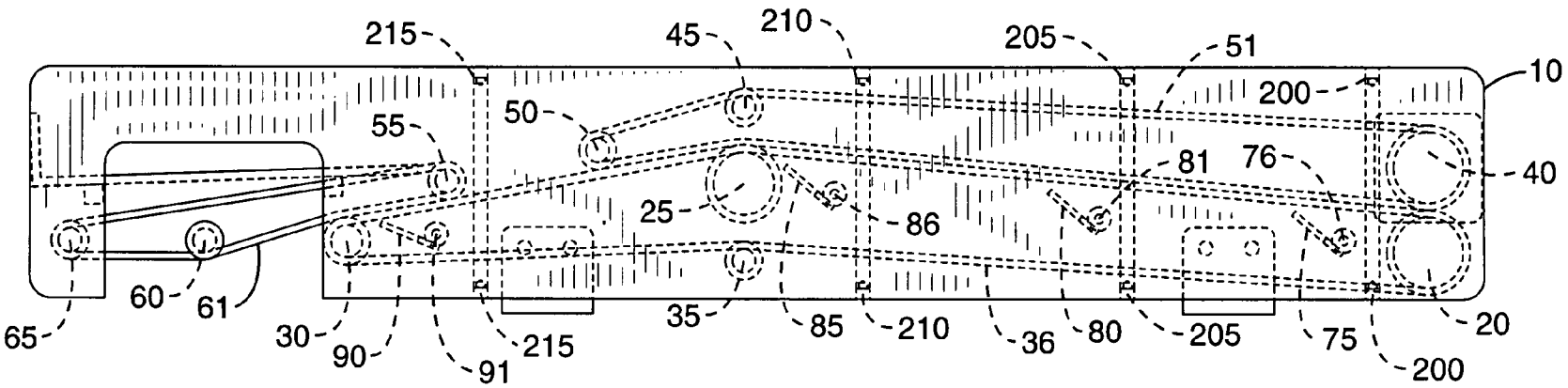
FIG. 2 is a cut-away side view of the subject device showing all four gates in the lowered or retracted positions.
Figure 3:
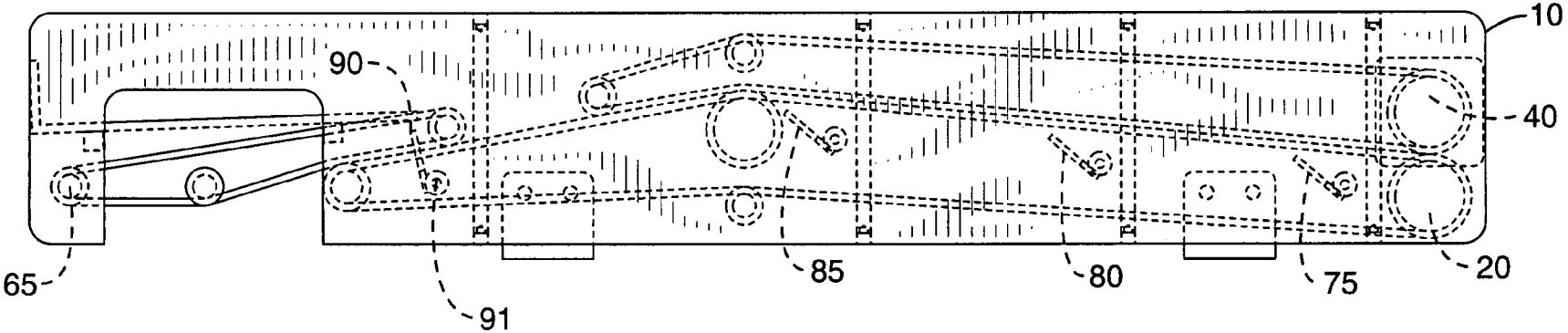
FIG. 3 is a cut-away side view of the subject device showing one gate in the up or extended position and the other three gates in the lowered or retracted positions.
Figure 4:
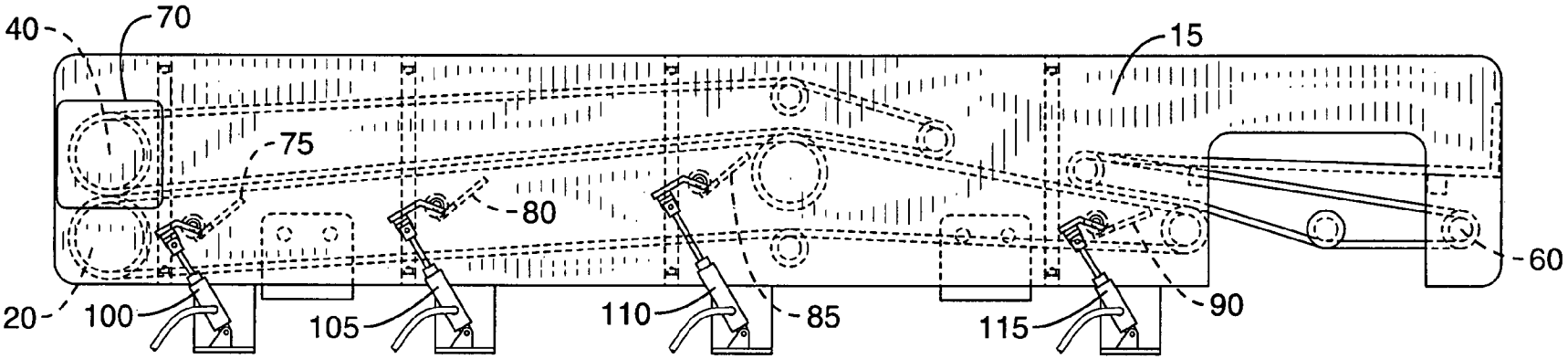
FIG. 4 is a cut-away side view of the subject device shown from the opposite side as seen in FIGS. 2 and 3.

Each gate 75, 80, 85, and 90 may be independently activated and pivoted into the path to block passage of a document packet or independently deactivated and pivoted away from the path to release a document packet to travel towards or into the inserter. Activation is often by associated pneumatic cylinders or electric solenoids that are suitably interfaced to the controlling computer system for activation or deactivation. Specifically shown in FIG. 4, compressed air cylinders 100, 105, 110, 115 are utilized to pivot gates 75, 80, 85, and 90, respectively, into and out of the path. When activated, each gate 75, 80, 85, and 90 moves into the document packet pathway and blocks the movement of the document packet. Since the belts 36, 51, and 61 only grip the document packet passively ("passively" meaning with a minimal force sufficient for path movement purposes), the belts slip on the document packet for a short duration until the belts cease movement, as directed by the controlling computer. Specifically, as seen in FIG. 3, only one gate 90 was activated to pivot about point 91 and into the document packet path to block the document docket. Clearly, one or more gates 75, 80, 85, and 90 may be activated if the situation arises. When the error that produced activation of a gate is remedied or corrected, each gate 75, 80, 85, and 90 may be disengaged by a command of the controlling computer to pivot down and out of the path to permit normal transport of a document packet, as seen in FIG. 2.

To detect if document packets are actually stopped and present behind any or all of the various gates 75, 80, 85, and 90 or that the document packet path areas behind the various gates 75, 80, 85, and 90 are open and free of document packets, suitable sensors are utilized and appropriately interfaced with the controlling computer system. Although other equivalent types of sensors are contemplated to be within the realm of this disclosure, a preferred sensor configuration is a paired light emitter and light receiver sensor 200, 205, 210, and 215. If a document packet is present the light between the emitter and receiver is blocked and the controlling system so notes and if no document packet is present the light passes from the emitter to the receiver and, again, the controlling system so notes.

Figure 5:
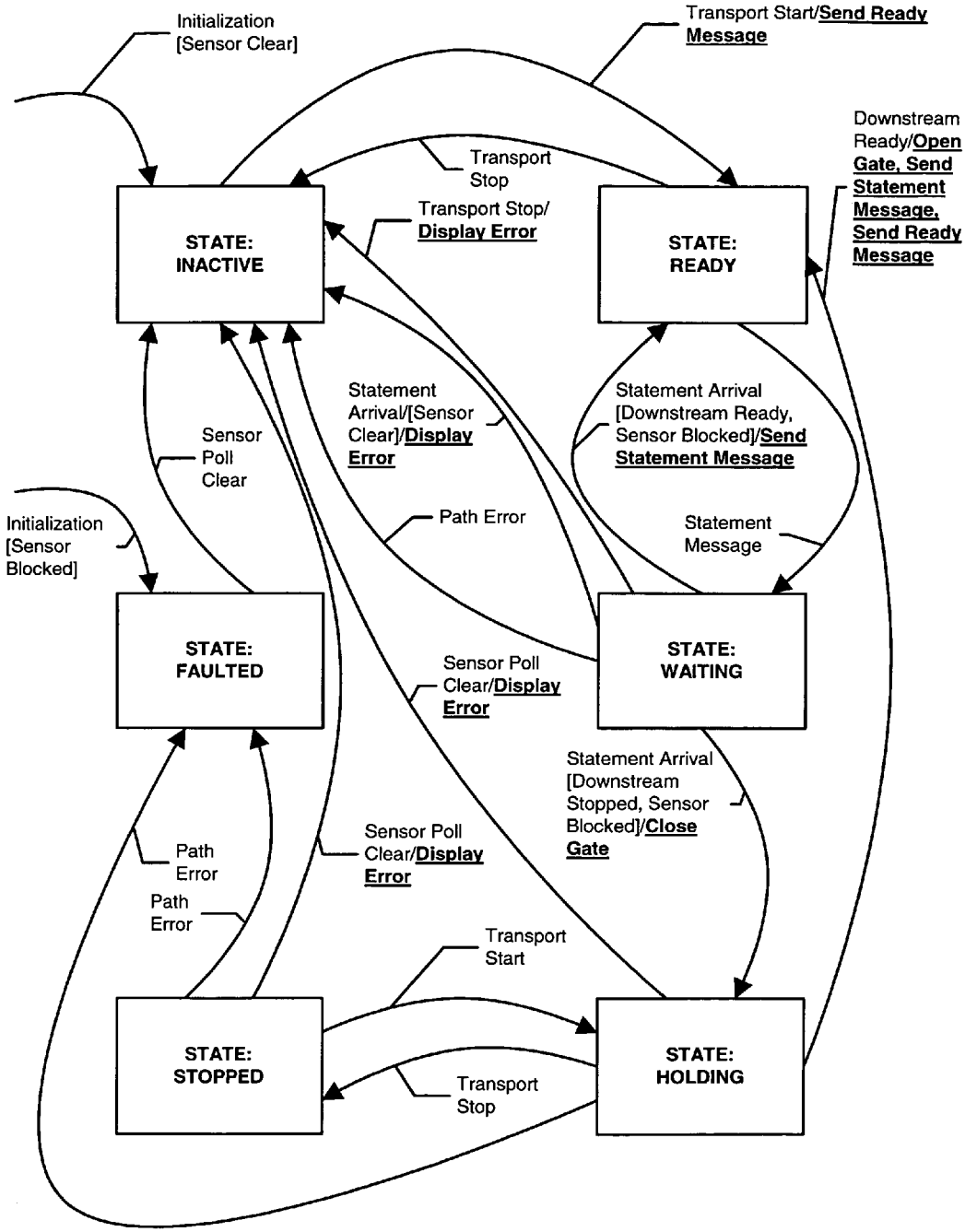
FIG. 5 is a state transition diagram for the controlling software utilized in the subject invention.

Specifically, as illustrate the FIG. 5 state transition diagram, the subject buffer device utilizes controlling software that interfaces with the controlling system of the associated inserter. When predetermined errors of various types are detected by the controlling system the subject buffer software is activated to control delivery of document packets to the inserter.

For purposes of clarity and by way of example and not by way of limitation, the control logic of the subject buffer gate device is specified by the behavior of a single buffer gate and in terms of the document packet specifically being a billing statement (usually for service provided or products purchased) generated by a suitable device upstream from the subject buffer device. Multiple instances of the same control program are activated, one for each buffer gate (four such gates 75, 80, 85, and 90 are illustrated in FIGS. 1-4).

A state transition diagram (shown in FIG. 5) is employed to specify the control logic of the subject buffer gate program. An explanation is provided below for the state transition diagram in general and provides specific examples to assist in fully understanding the state transition diagram for the subject buffer gate program. Before describing the subject state transition diagram, it is deemed appropriate to identify and describe the events the subject control program detects and the actions the control program takes. In addition, it is appropriate to list the states the control program occupies and the conditions (data values) the program can access. To fully specify the behavior of the subject program the state transition diagram utilizes four elements: 1) events, 2) actions, 3) states, and 4) conditions.

1) Events

The subject buffer gate program responds to the following events:

TABLE 1

EVENTS RESPONDED TO BY THE SUBJECT PROGRAM

| Event | Means of detection |
|---|---|
| Initialization | This event is common to all control programs and represents the start of the program. |
| Statement Message | The statement message is a software signal sent by a device upstream from the gate to indicate that a statement has been sent. |
| Statement Arrival | The statement arrival event is provided by an encoder system that signals the program when the transport has reached the position corresponding to the arrival of a statement at the gate. |
| Transport Start | This software signal is provided by the system management software when the transport starts. |
| Transport Stop | This software signal is provided by the system management software when the transport stops. |
| Downstream Ready | This software signal is sent by a device downstream from the gate when it is able to receive a statement. For example, when an inserter is enabled and has an empty slot in its input section it sends this signal to the buffer gate closest to the inserter. In addition, each buffer gate sends this information to the adjacent upstream buffer gate when it has released a statement and can now receive a statement. |
| Downstream Stopped | This software signal is sent by the device downstream from the gate when it is not able to receive a statement. For example when the inserter jams and has a statement in its input section it sends this signal to the buffer gate closest to the inserter. In addition each buffer gate sends this information to the adjacent upstream buffer gate when it is holding a statement. |

TABLE 1-continued

EVENTS RESPONDED TO BY THE SUBJECT PROGRAM

| Event | Means of detection |
|---|---|
| Sensor Poll Clear | This software signal is sent by a standard polling thread that monitors the state of the sensor at the buffer gate when the sensor transitions from blocked to clear. |
| Path Error | This software signal is sent by various external programs for various possible reasons. The signal indicates that the identity or reliability of material on the transport is no longer certain. |

2) Actions

The subject buffer gate control program takes the following actions.

TABLE 2

ACTIONS TAKEN BY THE SUBJECT PROGRAM

| Action | Means of actuation |
|---|---|
| Open Gate | Switch the gate so that each statement is allowed to pass. |
| Close Gate | Switch the gate so that a statement is held at the gate. |
| Send Statement Message | Send a software signal to a downstream device to indicate that a statement has been released. |
| Send Ready Message | Send a software signal to an upstream device to indicate that the gate can now receive a statement. |
| Send Stopped Message | Send a software signal to an upstream device to indicate that the gate cannot receive a statement because it is already holding one. |
| Display Error | Display an error message and stop the insertion system so that the operator can correct an error. |

3) States

The subject buffer gate program is always in one of the following states:

TABLE 3

STATES IN WHICH THE SUBJECT PROGRAM ALWAYS EXISTS

| State | Conceptual description |
|---|---|
| Inactive | The transport is stopped and the buffer gate sensor is clear. |
| Ready | The transport is running, the gate is open, and no statements are expected from an upstream device. |
| Waiting | The transport is running, the gate is open, and a statement is expected from an upstream device but has not yet arrived. |
| Holding | The transport is running and a known statement is being held at the gate. |
| Stopped | The transport is stopped and a known statement is being held at the gate. |
| Faulted | The transport is stopped and unsuitable/unmailable material is held at the gate. |

4) Conditions

The subject buffer gate program can determine the following conditions at any point in time.

TABLE 4

CONDITIONS DETERMINED BY THE SUBJECT PROGRAM

| Condition | Means of accessing/maintaining the data |
|---|---|
| Sensor Blocked/Clear | The buffer gate program can directly read the state of the gate sensor at any time. |
| Downstream Ready/Stopped | The buffer gate program records the most recent message from a downstream device to indicate whether it is currently ready or stopped. |

State Transition Diagram—Background (see FIG. 5)

The subject control program responds to events by taking actions. The specific action taken in response to an event is determined by the state of the program at the time the event occurs and may also depend on the value of one or more conditions. In addition to taking the indicated action, the program also changes its state. The state transition diagram, shown in FIG. 5, documents the system's behavior as transition arrowed-lines leading from one state to another. Each transition arrowed-line represents an event and may also contain an action. Further, if a transition arrowed-line behavior depends on any condition the transition arrowed-line shows a required value for the condition. To determine the response of the system to a sequence of events the transition arrowed-line of interest is "followed" to observe what action is taken in response to each event.

The Buffer Gate Program and State Transition Diagram (see FIG. 5)

To clarify the meaning of the state transition diagram seen in FIG. 5, behavior examples for the subject buffer gate program are provided.

The following tables (Tables 5-8) show example scenarios handled by the subject program. In each scenario a hypothetical sequence of events occurs. Each table shows the action taken in response to each event. The "State" column shows the state of the system at the time the event occurs. (Note that the state of the system on one row is the result of the transition occurring on the previous row.)

Throughout each example sequence the action can be determined from the state transition diagram, FIG. 5, as follows. First, find the rectangle on the diagram corresponding the state (remembering that the subject program is always in one of the six listed states in Table 3, above). Then examine the arrows leading out of the rectangle and find the one labeled with the event that has occurred. The bold-underlined text indicates the action taken in response to the event.

Note that the same event will trigger a different action in different states. For example, in Sequence 1 the transport start event triggers a Send Ready Message action when the state was Inactive. However, when the state was Stopped the Transport Start triggered no action.

Finally note that in each state only a subset of the list of events has an outbound transition. This is because in each state some events are ignored by the program or simply can not occur. For example, when the buffer gate is in the Faulted state a Downstream Ready message is ignored. In the Waiting state the system does not poll the sensor so the Sensor Poll Clear event can not occur.

TABLE 5

SEQUENCE 1 - NORMAL

| State | Event | Response (Action) |
|---|---|---|
| None - program not activated | Initialization | (none) |
| Inactive | Transport Start | Send Ready Message |
| Ready | Transport Stop | (none) |
| Inactive | Transport Start | Send Ready Message |
| Ready | Statement Message | (none) |
| Waiting | Statement Arrival [Downstream Ready, Sensor Blocked] | Send Statement Message |
| Ready | Statement Message | (none) |
| Waiting | Statement Arrival [Downstream Stopped, Sensor Blocked] | Close Gate |

TABLE 5-continued

SEQUENCE 1 - NORMAL

| State | Event | Response (Action) |
|---|---|---|
| Holding | Transport Stop | (none) |
| Stopped | Transport Start | (none) |
| Holding | Downstream Ready | Open Gate, Send Statement Message, Send Ready Message |
| Ready | | |

For Sequence 2,

TABLE 6

SEQUENCE 2 - STATEMENT FAILS TO ARRIVE AT GATE

| State | Event | Response (Action) |
|---|---|---|
| Ready | Statement Message | (none) |
| Waiting | Statement Arrival [Downstream Ready, Sensor Clear] | Display Error |
| Inactive | | |

For Sequence 3,

TABLE 7

SEQUENCE 3 - STATEMENT REMOVED FROM GATE

| State | Event | Response (Action) |
|---|---|---|
| Ready | Statement Message | (none) |
| Waiting | Statement Arrival [Downstream Ready, Sensor Blocked] | Send Statement Message |
| Ready | Statement Message | (none) |
| Waiting | Statement Arrival [Downstream Stopped, Sensor Blocked] | Close Gate |
| Holding | Sensor Poll Clear | Display Error |
| Inactive | | |

For Sequence 4,

TABLE 8

SEQUENCE 4 - GATE CONTENTS UNKNOWN

| State | Event | Response (Action) |
|---|---|---|
| Ready | Statement Message | (none) |
| Waiting | Statement Arrival [Downstream Ready, Sensor Blocked] | Send Statement Message |
| Ready | Statement Message | (none) |
| Waiting | Statement Arrival [Downstream Stopped, Sensor Blocked] | Close Gate |
| Holding | Path Error | (none) |
| Faulted | Sensor Poll Clear | (none) |
| Inactive | | |

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A document transfer buffer device for holding temporarily a document between an upstream document feeding device and a downstream document receiving device, comprising:

a) means for transporting the document from the upstream document feeding device to the downstream document receiving device;

b) means associated with said transporting means for temporarily holding the document in a holding location between the upstream document feeding device and the downstream document receiving device; and c) control means that selectively activates said transporting means and inactivates said transporting means when said temporary holding means is temporarily holding the document and said temporary holding means and is responsive to the upstream feeding device and the downstream receiving device conditions that initiate document holding and releasing situations.

2. A document transfer buffer device according to claim 1, wherein said control means comprises a programmed set of instructions that direct operations for said transporting means to transport said document or stop transport when said temporary holding means is holding said document and said temporary holding means.

3. A document transfer buffer device according to claim 1, further comprising a sensor associated with said transport means for locating the document within said transport means and interfaced with said operations directing programmed set of instructions.

4. A document transfer buffer device according to claim 1, wherein said transporting means comprises:

a) a supporting frame and b) paired upper and lower transport assemblies attached to and within said supporting frame for transporting the document.

5. A document transfer buffer device according to claim 1, wherein said temporary holding means comprises:

a) gate means for temporarily blocking transport of the document to the downstream document receiving device and b) control means for selectively activating and deactivating said gate means.

6. A document transfer buffer device according to claim 5, wherein said gate means comprises a pivoting member that rotates into a pathway the document travels within said transporting means when said control means indicates activation for said gate and rotates away from said document pathway when said control means indicates deactivation for said gate.

7. A document transfer buffer device for holding temporarily a document between an upstream document feeding device and a downstream document receiving device, comprising:

a) means for transporting the document from the upstream document feeding device to the downstream document receiving device;

b) pivoting gate means associated with said transporting means for temporarily holding the document in a holding location between the upstream document feeding device and the downstream document receiving device; and c) control means that selectively activates said transporting means and inactivates said transporting means when said temporary pivoting gate means is temporarily holding the document and said pivoting gate temporary holding means.

8. A document transfer buffer device according to claim 7, wherein said control means comprises a programmed set of instructions that direct operations for said transporting means to transport said document or stop transport when said pivoting gate temporary holding means is holding said document and said pivoting gate temporary holding means.

9. A document transfer buffer device according to claim 7, further comprising a sensor associated with said transport means for locating the document within said transport means and interfaced with said operations directing programmed set of instructions.

10. A document transfer buffer device according to claim 7, wherein said transporting means comprises:

a) a supporting frame and b) paired upper and lower transport assemblies attached to and within said supporting frame for transporting the document.

11. A document transfer buffer device according to claim 7, wherein said gate means comprises a pivoting member that rotates into a pathway the document travels within said transporting means when said control means indicates activation for said gate and rotates away from said document pathway when said control means indicates deactivation for said gate.

12. A document transfer buffer device for holding temporarily a document between an upstream document feeding device and a downstream document receiving device, comprising:

a) means for transporting the document from the upstream document feeding device to the downstream document receiving device, wherein said transporting means comprises:

i) a supporting frame and ii) paired upper and lower transport assemblies attached to and within said supporting frame for transporting the document;

b) a plurality of pivoting gate members, wherein each of said pivoting gate members rotates into a pathway the document travels within said transporting means when a control means indicates activation for each said gate and rotates away from said document pathway when said control means indicates deactivation for each said gate;

c) said control means that selectively activates said transporting means to transport said document or stop transport when said pivoting gate members are holding said document and each of said pivoting gate members; and d) a sensor associated with each of said plurality of pivoting gate members for locating the document within said transport means and interfaced with said control means.

13. A document transfer buffer device according to claim 12, wherein said control means comprises a programmed set of instructions that direct operations for said transporting means to transport said document or stop transport when said pivoting gate members are holding said document and each of said pivoting gate members.

14. A document transfer buffer system for use with one or more documents being transferred from an upstream document feeding device to a downstream envelope inserter, comprising:

a) means for transporting each of the documents from the upstream document feeding device to the downstream envelope inserter, wherein said transporting means comprises:

i) a supporting frame and ii) paired upper and lower transport assemblies attached to and within said supporting frame for transporting each of the documents;

b) a document buffer positioned within said transporting means, comprising:

a plurality of pivoting gate members, wherein each of said pivoting gate members rotates into a pathway that each of the documents travels within said transporting means when a control means indicates activation for each said gate and rotates away from said document pathway when said control means indicates deactivation for each said gate;

c) said control means that selectively activates said transporting means to transport said document or stop transport when said pivoting gate members are holding said document and each of said pivoting gate members; and d) a sensor affixed proximate each of said plurality of pivoting gate members for locating each of the documents within said transport means and interfaced with said control means.

15. A document transfer buffer system for use with one or more documents being transferred from an upstream document feeding device to a downstream envelope inserter, comprising:

a) means for transporting each of the documents from the upstream document feeding device to the downstream envelope inserter, wherein said transporting means is activated to move the documents and inactivated while said documents are temporarily held by a document buffer and comprises:

i) a supporting frame and ii) paired upper and lower transport assemblies attached to and within said supporting frame for transporting each of the documents;

b) said document buffer positioned within said transporting means, comprising:

a plurality of pivoting gate members, wherein each of said pivoting gate members rotates into a pathway that each of the documents travels within said transporting means when a controlling program indicates activation for each said gate and rotates away from said document pathway when said control means indicates deactivation for each said gate;

c) said controlling program that selectively activates said transporting means to transport said documents or stop transport when said pivoting gate members are holding said documents and each of said pivoting gate members, wherein if said controlling program detects an error in the processing of any of the incoming documents, one or more of the incoming documents may be temporarily halted, within said transporting means that is directed to stop transport and behind one of said pivoting gate members, before entry into the envelope inserter and buffered or cued in known order until said controlling program processes the detected error and the error situation is remedied and then directs any cued documents to once again enter the envelope inserter by activating movement of said transporting means and rotating each said gate away from said document pathway; and d) a sensor affixed proximate each of said plurality of pivoting gate members for locating each of the documents within said transport means and interfaced with said controlling program.

* * * * *